US009869051B2

(12) United States Patent
Hong

(10) Patent No.: US 9,869,051 B2
(45) Date of Patent: Jan. 16, 2018

(54) DRYER FOR WALL-MOUNTED WASHING MACHINE

(71) Applicant: Dongbu Daewoo Electronics Corporation, Seoul (KR)

(72) Inventor: Seong Bo Hong, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 566 days.

(21) Appl. No.: 14/145,902

(22) Filed: Dec. 31, 2013

(65) Prior Publication Data

US 2015/0176191 A1 Jun. 25, 2015

(30) Foreign Application Priority Data

Dec. 23, 2013 (KR) ..... 10-2013-0161290

(51) Int. Cl.

| | |
|---|---|
| ***D06F 58/02*** | (2006.01) |
| ***D06F 58/26*** | (2006.01) |
| ***D06F 39/12*** | (2006.01) |
| ***D06F 25/00*** | (2006.01) |

(52) U.S. Cl.

CPC ..... *D06F 58/02* (2013.01); *D06F 25/00* (2013.01); *D06F 39/12* (2013.01); *D06F 58/26* (2013.01)

(58) Field of Classification Search

CPC ..... D06F 58/02; D06F 58/26; D06F 25/00; D06F 39/12

See application file for complete search history.

(56) References Cited

U.S. PATENT DOCUMENTS

| | | | | |
|---|---|---|---|---|
| 4,946,568 | A * | 8/1990 | Kalwar | H01T 19/00 204/164 |
| 2006/0101589 | A1 | 5/2006 | Hong et al. | |
| 2006/0169006 | A1 | 8/2006 | Lim et al. | |
| 2009/0020520 | A1 * | 1/2009 | Forget | H05B 3/16 219/461.1 |
| 2012/0242205 | A1 | 9/2012 | Del Pos et al. | |

FOREIGN PATENT DOCUMENTS

| | | | |
|---|---|---|---|
| EP | 2206821 | A1 | 7/2010 |
| EP | 2471994 | A1 | 7/2012 |
| KR | 20030061190 | A | 1/2002 |
| KR | 20020034873 | B1 | 2/2003 |
| KR | 2003-0061190 | | 7/2003 |
| KR | 2004-0022828 | | 3/2004 |
| KR | 2005-0082862 | | 8/2005 |
| KR | 2006-0032328 | | 4/2006 |
| KR | 10-0635635 | B1 | 10/2006 |
| KR | 20090118762 | A | 11/2009 |
| KR | 20120056705 | A | 6/2012 |
| WO | 2010/137910 | A | 12/2010 |
| WO | 2013073340 | A2 | 5/2013 |

* cited by examiner

*Primary Examiner* — Jessica Yuen

(57) ABSTRACT

A dryer for a wall-mounted washing machine is disclosed. The dryer provides a duct passage that is curved in multiple ways, and that has a heater and a fan. Therefore, the dryer may be installed in a wall-mounted washing machine having a relatively small or narrow accommodating space. The dryer may have a relatively high gas flow rate and/or flow velocity. That is, the dryer may implement a function for drying laundry.

12 Claims, 9 Drawing Sheets

DRYER FOR WALL-MOUNTED WASHING MACHINE

CROSS-REFERENCE TO RELATED APPLICATIONS

This application is based on and claims priority from Korean Patent Application No. 10-2013-0161290, filed on Dec. 23, 2013, the disclosure of which is incorporated herein in its entirety by reference.

TECHNICAL FIELD

The present disclosure relates to a dryer for a wall-mounted washing machine, and more particularly, to a dryer for a wall-mounted washing machine that is mounted in a wall-mounted washing machine and configured to dry laundry.

BACKGROUND

In a general wall-mounted washing machine, a washing drum is in a washing tub, which may be integral with an installation plate. The drum may be driven by a forward and reverse motor, and a water supply pipe and a water drain pipe are connected to the washing tub.

The washing machine includes a hot air blower which supplies hot air to the washing tub, a blower which discharges air in the washing tub, and a control panel with control buttons for selecting options for washing, spin-drying, rinsing, and drying laundry. The control panel is configured to control the hot air blower and the blower.

The forward and reverse motor that drives the washing drum and the hot air blower are at an upper side of the installation plate.

A conventional wall-mounted washing machine may be disclosed in Korean Utility Model Registration No. 20-0305578 (published on Feb. 26, 2003).

A main object of installing the wall-mounted washing machine is to implement an original function of a washing machine while reducing the occupancy space. However, in the case of Korean Utility Model Registration No. 20-0305578, because certain elements in the wall-mounted washing machine are not integrated, the size of the wall-mounted washing machine may be relatively large.

A wall-mounted drum type washing machine may be disclosed in Korean Patent Application Laid-Open No. 10-2013-0112643 (published on Oct. 14, 2013, Title: Wall-Mounted Drum Type Washing Machine).

However, in the case of Korean Patent Application Laid-Open No. 10-2013-0112643, an object of minimizing a washing machine is achieved by reducing a size of the external shape thereof, but a laundry drying function is not provided.

Therefore, there is a need for a compact dryer in order to provide a laundry drying function for a wall-mounted washing machine.

SUMMARY

The present disclosure has been made in an effort to provide a dryer for a wall-mounted washing machine, which may be miniaturized to be in a wall-mounted washing machine.

A technical object to be achieved in the present disclosure is not limited to the aforementioned technical object(s), and other unmentioned technical objects will be understood from the description below by those skilled in the technical field(s) to which the present disclosure pertains.

One or more exemplary embodiments of the present disclosure provide a dryer for a wall-mounted washing machine, including a duct body having a passage therein configured to guide gas from an inlet to an outlet, the passage being curved laterally and vertically, and the outlet is directed toward a tub and/or drum of the washing machine; a heater at the inlet, configured to heat the gas; a fan at the inlet, outside the heater, configured to blow the gas toward the heater; and a duct cover at an upper side of the duct body, and corresponding to a shape of the duct body.

The dryer for a wall-mounted washing machine according to exemplary embodiments of the present disclosure may further comprise a tube at the outlet of the duct body, wherein a cross-sectional area of the tube may be smaller than a cross-sectional area of the inlet, which may increase a flow velocity of the gas.

The dryer for a wall-mounted washing machine according to exemplary embodiments of the present disclosure may further comprise a partition on or in the passage of the duct body, configured to maintain the flow velocity of the gas.

The partition may extend to the tube to maintain the flow velocity of the gas.

The dryer for a wall-mounted washing machine according to the exemplary embodiment of the present disclosure may comprise a plurality of partitions, the partitions may have an inclined portion nearest to the inlet, and the inclined portions may uniformly distribute the gas and/or a fluid to a plurality of passages formed by the plurality of partitions.

Widths of the plurality of passages formed by the plurality of partition may be uniform.

The duct cover may have a groove at a position that corresponds to the partition, and a part of the partition may be in (e.g., inserted into) the groove to prevent the gas from leaking.

The duct cover may have a curved portion that corresponds to the tube.

The dryer for a wall-mounted washing machine according to exemplary embodiments of the present disclosure may further comprise first and second stoppers at the inlet of the duct body, and the heater may be aligned between the first stopper and the second stopper.

The heater may include a frame having a spacer on an inner surface thereof and a heating device in the frame, wherein the spacer defines an interval between the frame and the heater that prevents the frame from being deformed by heat from the heating device.

The fan may include a fan housing which having open ends, an opening in a side surface of the housing, a blower in the fan housing, configured to blow gas toward the opening; and a fan motor in the fan housing configured to rotate the blower.

A cross-sectional shape of the opening may correspond to a cross-sectional shape of the inlet, which may be formed by the duct body and the duct cover.

The blower may comprise a sirocco fan.

Specific items of other embodiments are included in the detailed description and the drawings.

The dryer for a wall-mounted washing machine according to exemplary embodiments of the present disclosure, configured as described above and/or elsewhere herein, may have a compact size (e.g., enabling a relatively small external shape for the washing machine), provide a high gas flow rate, and produce warm air. That is, the dryer according to exemplary embodiments of the present disclosure may be mounted in the wall-mounted washing machine, thereby implementing a laundry drying function in the wall-mounted washing machine.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
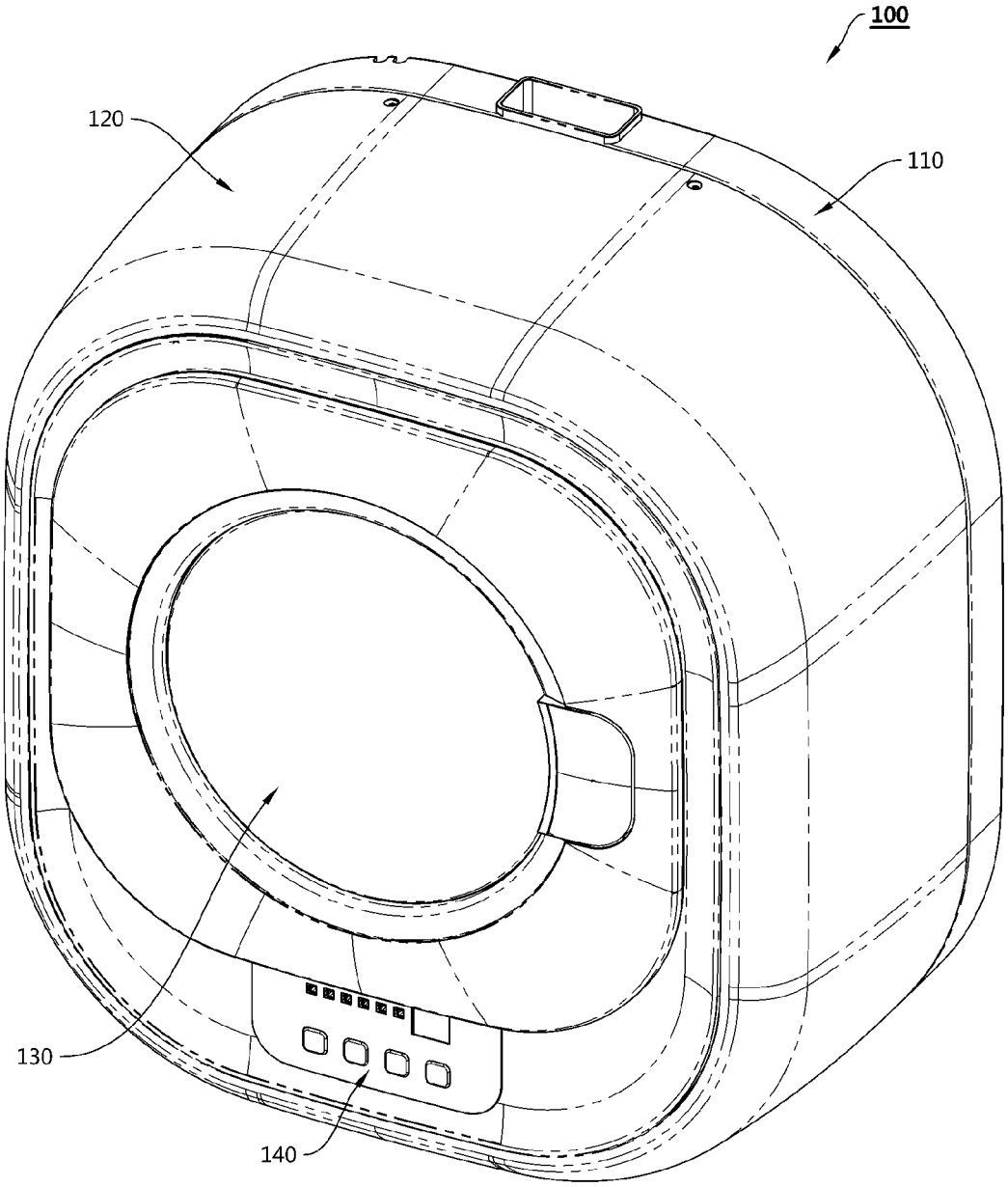
FIG. 1 is a view of a wall-mounted washing machine.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Advantages and features of the present disclosure and methods of achieving the advantages and features will be clear with reference to one or more exemplary embodiments described in detail below, together with the accompanying drawings.

Hereinafter, exemplary embodiments of the present disclosure will be described in detail with reference to the accompanying drawings. It should be appreciated that the exemplary embodiments described below are illustratively described for helping the understanding of the present disclosure, and the present disclosure may be modified to carry out various embodiments different from the exemplary embodiments described herein. However, in the description of the present disclosure, detailed descriptions and specific drawings for known functions and constituent elements may be omitted when the detailed descriptions and the specific drawings may unnecessarily obscure the subject matter of the present disclosure. For helping the understanding of the present disclosure, the accompanying drawings are not necessarily illustrated based on the actual scale, but part or all of the constituent elements may be exaggerated in terms of size.

Meanwhile, terms used in the description are defined in consideration of the functions and/or operations of the present disclosure and may vary depending on the intention or usual practice of a manufacturer. Therefore, the definitions should be based on the entire contents of the present specification.

Like reference numerals indicate like elements throughout the specification and drawings.

Hereinafter, a wall-mounted washing machine will be described with reference to FIGS. 1 and 2.

The accompanying FIG. 1 is a view for explaining a wall-mounted washing machine. FIG. 2 is a view for explaining an internal space of the wall-mounted washing machine.

As illustrated in FIG. 1, a wall-mounted washing machine 100 has a casing 120 at a front side of a body frame 110, and a door 130 at a front side of the casing 120. A control unit 140, which controls the wall-mounted washing machine 100, is in and/or on the casing 120.

Figure 2:
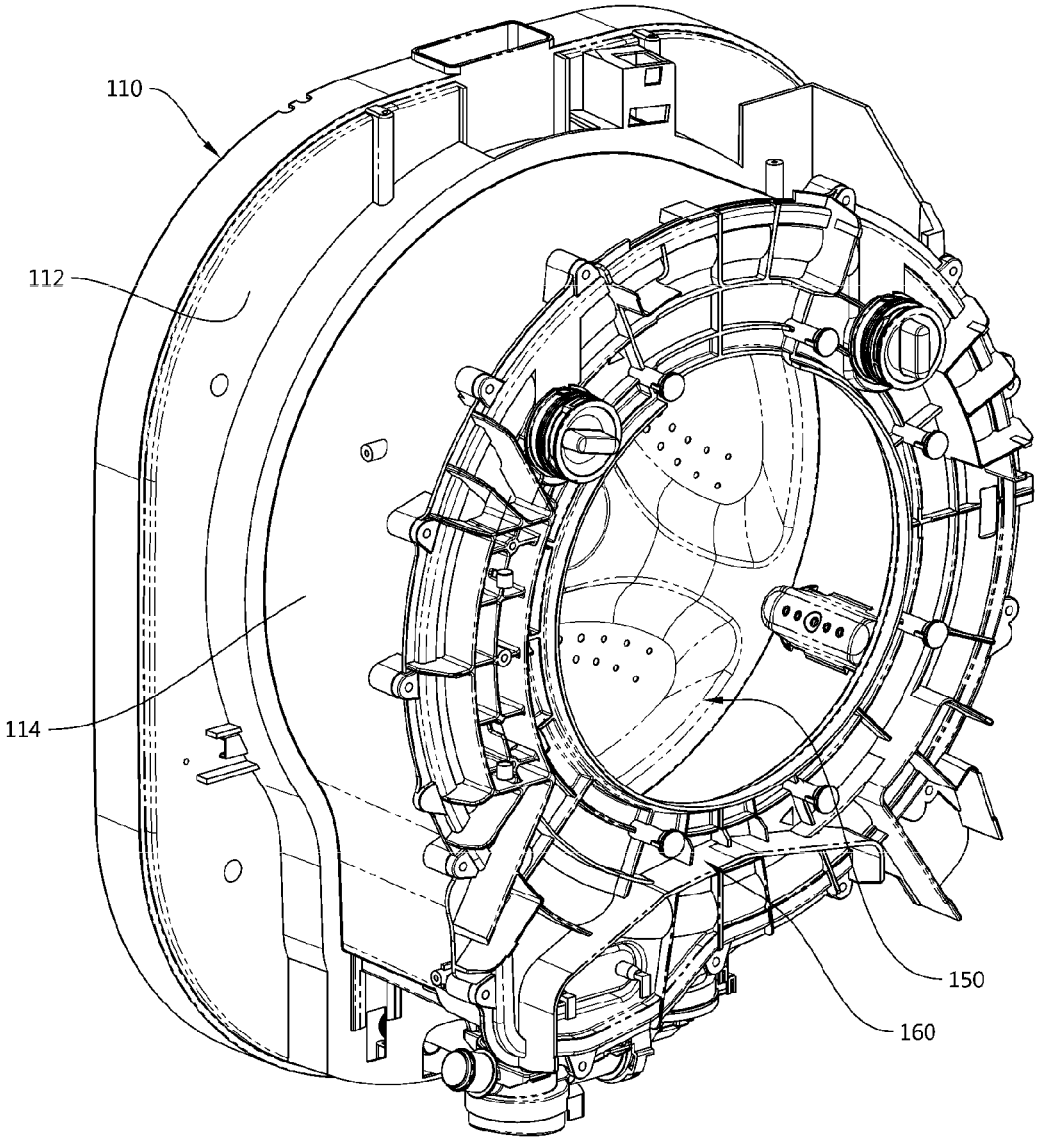
FIG. 2 is a view of an internal space of a wall-mounted washing machine.

As illustrated in FIG. 2, the body frame 110 may comprise a panel 112 and a tub 114. The panel 112 has a substantially flat, circular, plate, square and/or rectangular shape, and in one embodiment, an approximately quadrangular shape (e.g., with rounded corners) when viewed from the front of the washing machine. The tub 114 is substantially cylindrical or conical, and has an approximately circular shape when viewed from the front of the washing machine. The casing 120 is assembled along an edge of the panel 112. A drum 150 is in the tub 114, and a drum cover 160 is at, on or over a front side of the tub 114.

The drum 150 is rotated by an electric motor to wash the laundry.

Piping for supplying water and piping for draining water are installed in the wall-mounted washing machine 100. Valves may be provided in the piping.

The wall-mounted washing machine 100 may have limited available space because various constituent elements are integrated into the space under the casing 120, as described above.

The wall-mounted washing machine 100 illustrated in FIGS. 1 and 2 may not have a function for drying laundry. As a result, it may be inconvenient to dry laundry washed by the washing machine 100.

Hereinafter, a dryer for a wall-mounted washing machine according to exemplary embodiments of the present disclosure will be described with reference to FIG. 3. The accompanying FIG. 3 is a view for explaining an example in which a dryer according to exemplary embodiments of the present disclosure is installed in a wall-mounted washing machine.

Figure 3:
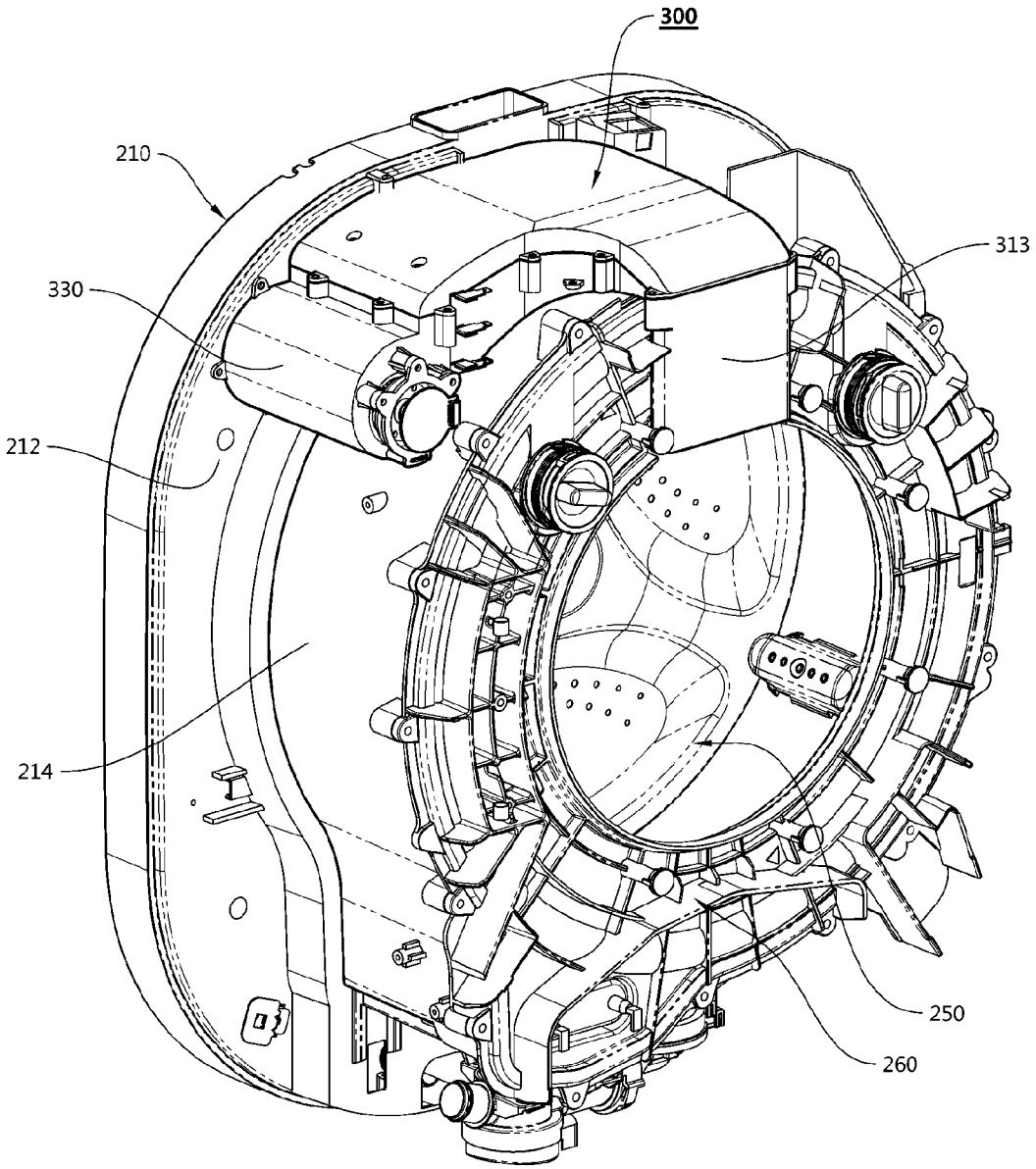
FIG. 3 is a view for explaining an example of a wall-mounted washing machine including a dryer according to one or more exemplary embodiments of the present disclosure.

As illustrated in FIG. 3, a dryer 300 is installed on a body frame 210 of a wall-mounted washing machine, and disposed or positioned so that warm air discharged from the dryer 300 is directed toward a drum 250.

A casing is provided at, on or over the front and sides of the washing machine, in contact with a front surface and/or edge of the body frame 210, similar to the wall-mounted washing machine 100 of FIGS. 1-2, and a door is at the front of the casing, similar to the wall-mounted washing machine 100 of FIGS. 1-2. A control unit configured to control the wall-mounted washing machine is on and/or in the casing, similar to the wall-mounted washing machine 100 of FIGS. 1-2.

The body frame 210 may comprise a panel 212 and a tub 214. The panel 212 has a substantially flat, circular, plate, square and/or rectangular shape, and in one embodiment, an approximately quadrangular shape (e.g., square or rectangular, with rounded corners) when viewed from the front of the washing machine. The tub 214 is generally cylindrical and/or conical, and has an approximately circular shape when viewed from the front of the washing machine. The drum 250 is in the tub 214, and a drum cover 260 is at, on and/or over the front of the tub 214.

An outlet of the dryer 300 is disposed or positioned at, on, over, around and/or through the drum cover 260 so as to provide warm air to the drum 250.

Meanwhile, when the body frame 210 is viewed from the front side, there is a relatively small and/or narrow space having an approximately triangular shape at one or more corners of the body frame 210, when the tub 214 and/or drum cover 260 are omitted from the panel 212. The dryer 300 according to one or more exemplary embodiments of the present disclosure is in the triangular space, and thus, the size and/or external shape of the dryer 300 may be relatively small.

Figure 5:
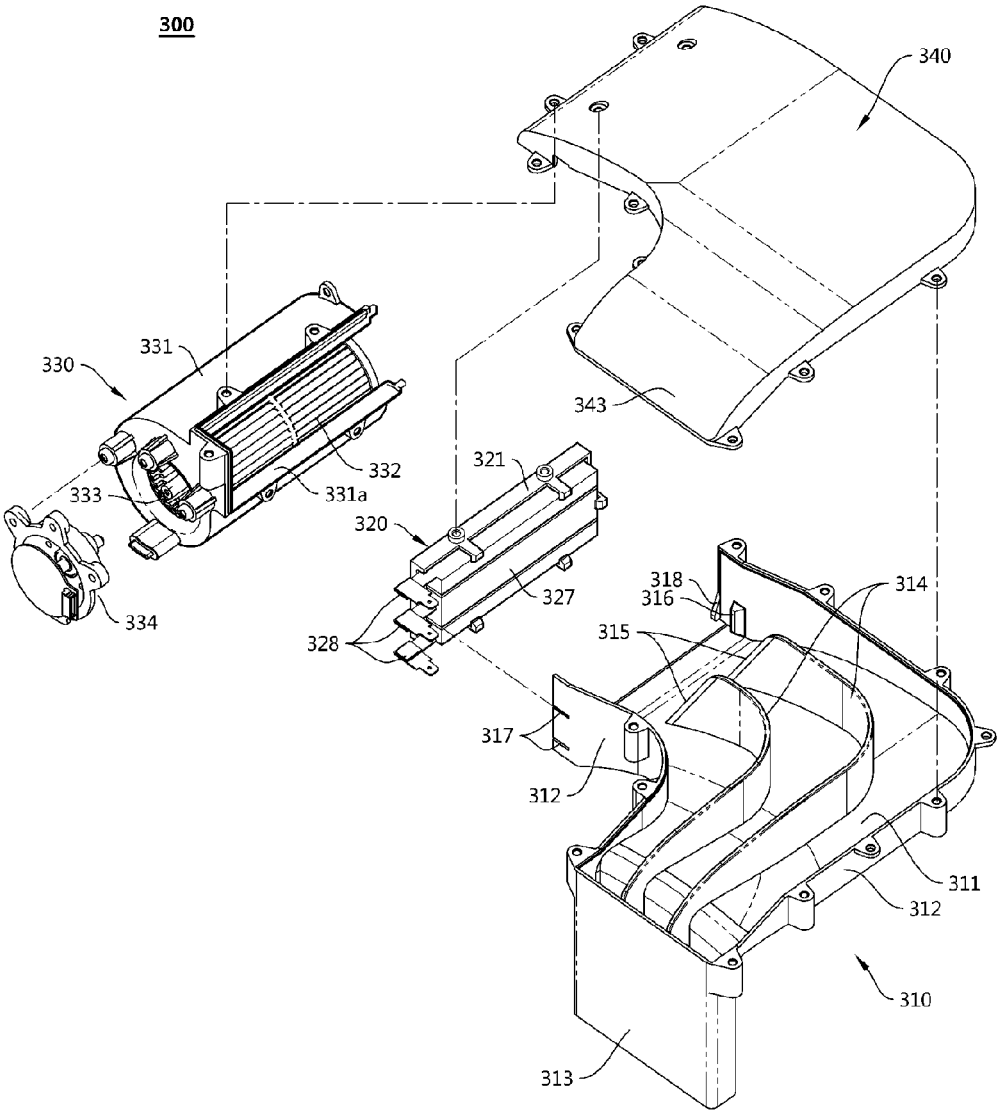
Figure 6:
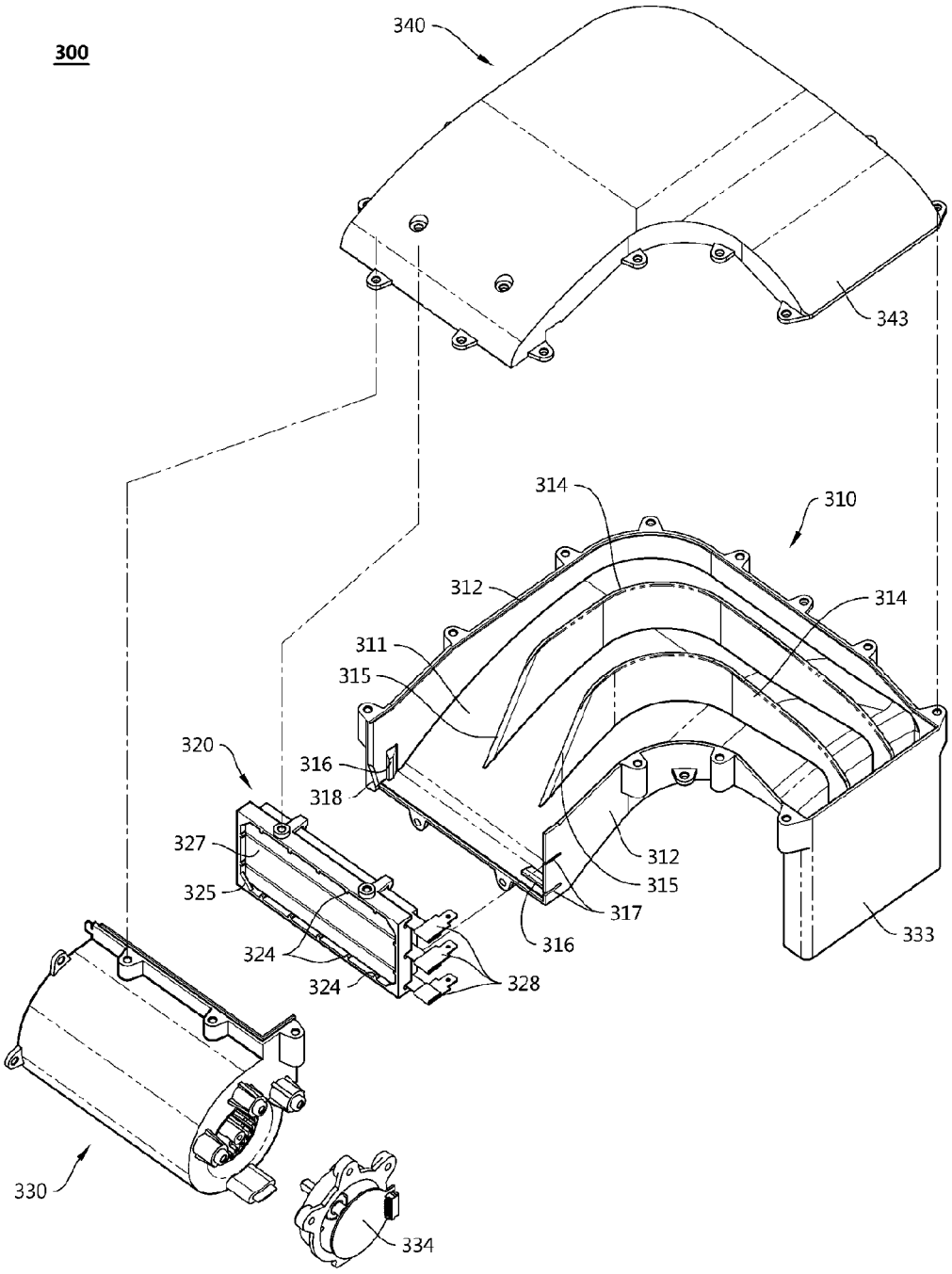

Hereinafter, the dryer 300 according to exemplary embodiments of the present disclosure will be described with reference to FIGS. 4 to 6. The accompanying FIGS. 4 to 6 are a perspective view and exploded views for explaining a configuration of the dryer according to exemplary embodiments of the present disclosure.

Figure 4:
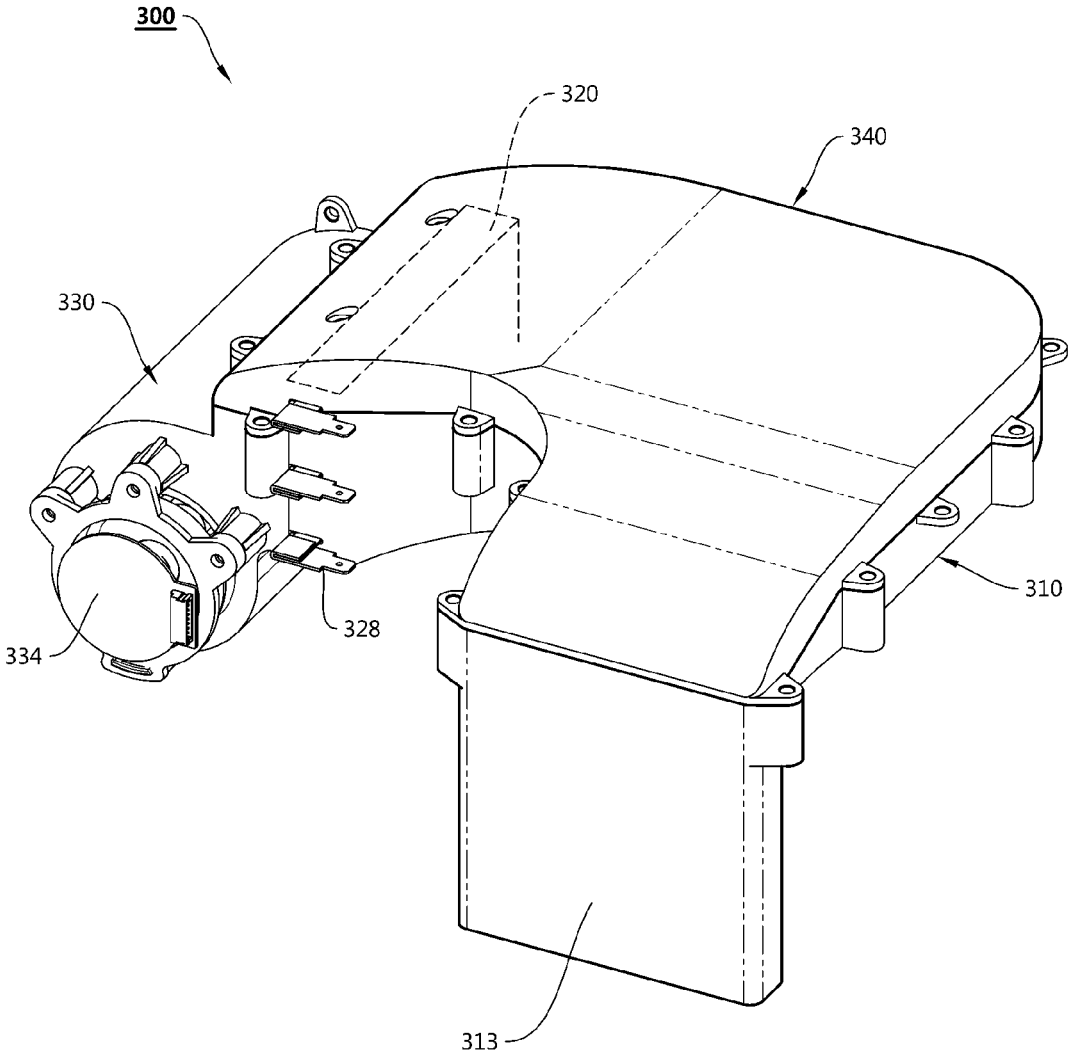
FIGS. 4 to 6 are a perspective view and exploded views for explaining a configuration of the dryer for a wall-mounted washing machine according to exemplary embodiments of the present disclosure.

As illustrated in FIG. 4, a passage through which gas moves is in or defined by a duct body 310 and a duct cover 340 of the dryer 300, and a heater 320 is upstream from the passage. A fan 330 is outside the heater 320.

The duct body 310 and the duct cover 340 are assembled to form the passage through which the gas flows. The passage has a laterally and vertically curved shape (e.g., the passage is curved when viewed from the top, and is curved when viewed from a lateral side). That is, the dryer 300 according to one or more exemplary embodiments of the present disclosure provides a structure which may minimize an occupancy space, and maximally secure the passage.

The passage in and/or along the duct body 310 may be formed and/or defined in part by duct side walls 312 at opposite sides of a duct base 311, and covered by with the duct cover 340.

The passage is configured to guide gas from an inlet to an outlet (e.g., of the passage and/or the duct). The passage is curved when viewed from the top side and when viewed from a lateral side. An arc or curved angle of the passage may be an approximately right angle in the laterally curved portion and/or the vertically curved portion, but is not limited thereto, and may be any angle as long as the passage avoids interference with various constituent elements of the washing machine.

The dryer 300 according to exemplary embodiments of the present disclosure is installed in a wall-mounted washing machine a relatively small and/or narrow space available for the dryer. For example, constituent elements of the washing machine, particularly, the body frame 210 and the casing, may be relatively small and/or narrow, and as a result, changes to the design of the washing machine may be limited when the passage of the duct is routed, placed and/or positioned. Therefore, the configuration in which the passage of the duct is curved at an approximately right angle when viewed from the top and from the lateral side, as described above, may be the best configuration.

Meanwhile, the outlet of the duct body 310 is directed toward the drum 250 of the washing machine.

A tube 313 may be formed at the outlet of the duct body 310. A cross-sectional area of the tube 313 may be smaller than a cross-sectional area of the passage at the inlet (e.g., of the passage and/or the duct), which may increase a flow velocity of the gas that flows through the passage and/or the duct. That is, the gas velocity increases as the cross-sectional area decreases, when the gas flows into the duct at a constant flow rate, resulting in the gas flowing into the drum 250 at a higher velocity than into the duct. Therefore, the laundry-drying effect may improve.

Figure 7:
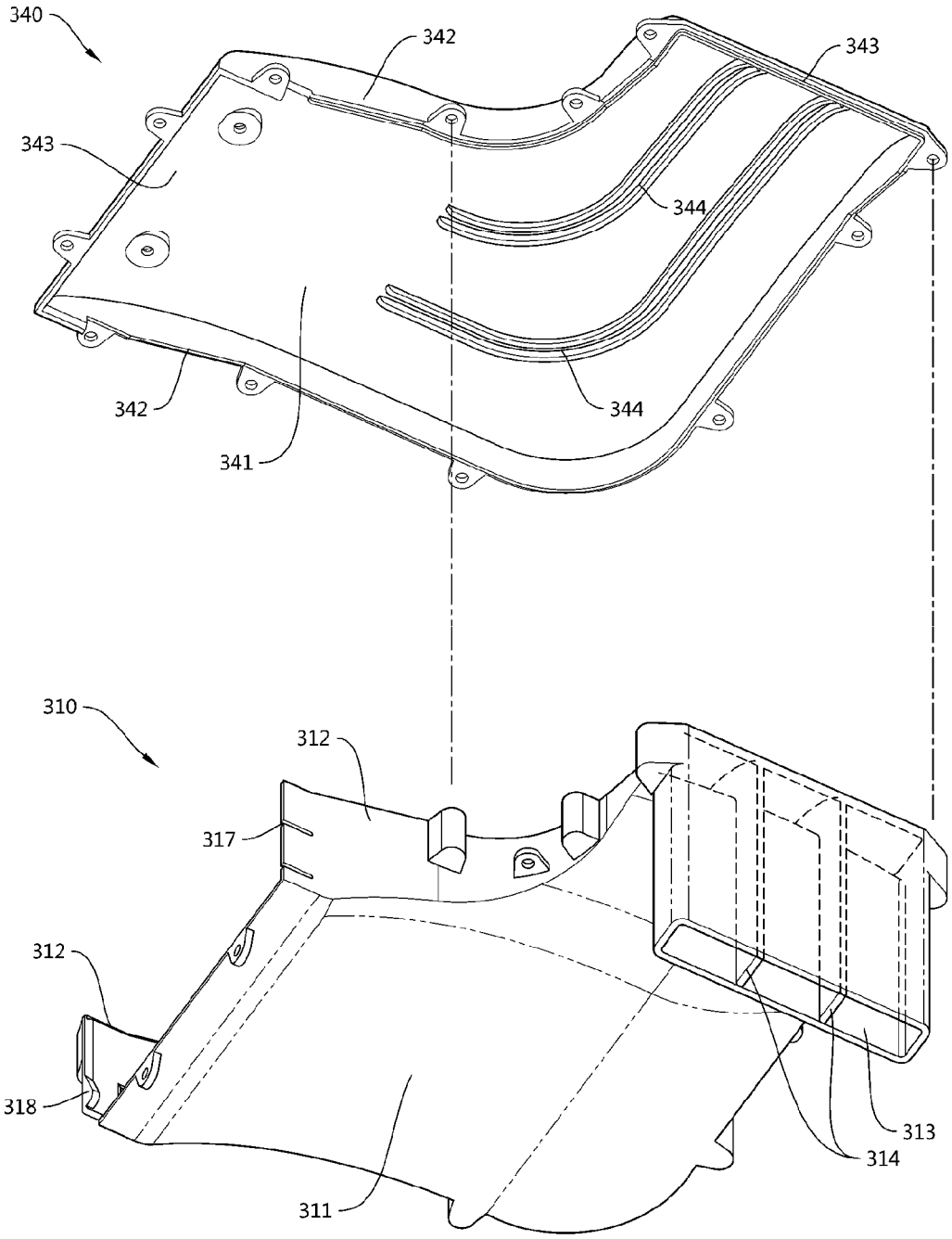
FIG. 7 is a view for explaining a duct body and a duct cover of the dryer according to exemplary embodiments of the present disclosure.
Figure 8:
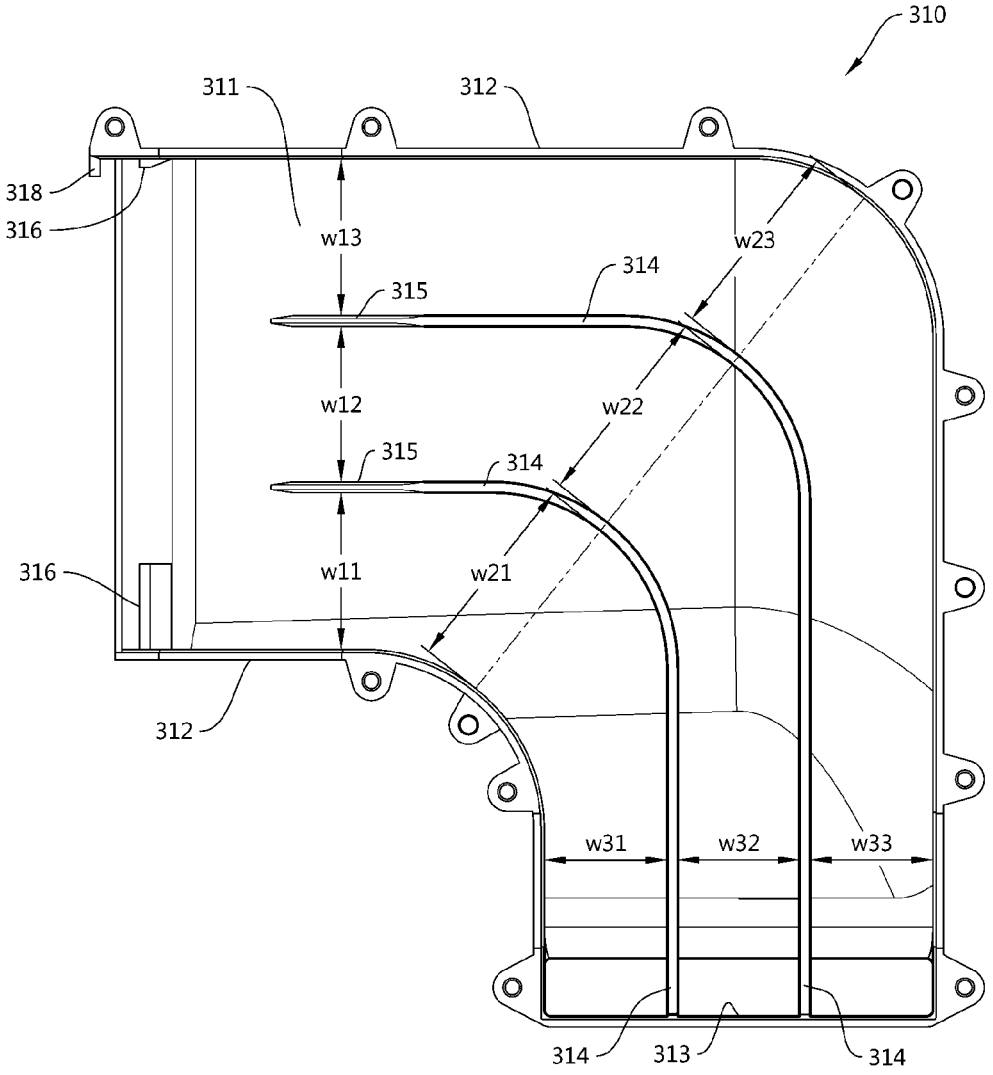
FIG. 8 is a top plan view for explaining the duct body of the dryer according to exemplary embodiments of the present disclosure.

Hereinafter, the duct body 310 and the duct cover 340 will be described in more detail with reference to FIGS. 7 and 8. FIG. 7 is a view for explaining the duct body and the duct cover of the dryer according to exemplary embodiments of the present disclosure. FIG. 8 is a top plan view for explaining the duct body of the dryer for a wall-mounted washing machine according to exemplary embodiments of the present disclosure.

Partitions 314 may be formed on or along the passage of the duct and/or the duct body 310. The partitions 314 may maintain the flow velocity and/or distribute the flow of the gas, thereby directing and/or maintaining the flow velocity of the gas until the gas is finally blown into the drum 250.

That is, when the gas passes through the passage of the duct, an eddy current may form due to interference between the gas and the wall of the passage (e.g., side walls 312, the base 311, the inside surface of the cover 340, etc.), and the eddy current(s) result in a decrease in flow velocity. When the passage of the duct is a wide single body, the eddy current is relatively large, and may affect or change a directionality of the flow of gas. This affected/changed flow of gas may be known as a turbulent flow.

However, the duct body 310 according to one or more exemplary embodiments of the present disclosure has a plurality of partitions 314 forming and/or providing a plurality of passages, and the passage(s) in the duct may be small (e.g., depending on the number of partitions and/or passages). When the cross section of each passage is small, a smaller eddy current is generated when the gas flows, and the directionality of gas flow is clearer (e.g., less affected or changed). This flow of gas is called a laminar flow. In some embodiments, substantially no eddy currents are generated.

That is, when warm air is provided to the drum 250, the warm air flows as a laminar flow by the plurality of partitions 314 according to one or more exemplary embodiments of the present disclosure. A loss of gas or fluid pressure is generally reduced, the flow velocity is increased, and as a result, a higher gas flow rate and/or more efficient gas flow may be provided to the drum 250.

On the other hand, the partition(s) 314 according to exemplary embodiments of the present disclosure may extend up to and/or through the entrance and/or interior of the tube 313, as illustrated in FIG. 7. Therefore, a high flow velocity of gas may be maintained, and the gas may be provided to the drum 250 at a high flow velocity, high efficiency, and/or relatively broad distribution.

The partition(s) 314 may have an inclined portion 315 at an inflow (e.g., a location nearest to the inlet). The inclined portion 315 may uniformly distribute gas and/or fluid to the plurality of passages formed by the plurality of partitions 314. In more detail, the inclined portion 315 of the partitions 314 according to an exemplary embodiment of the present disclosure forms an available section which allows the gas to be distributed a relatively low pressure area in each of the passages. That is, when gas or fluid flows at an uneven concentration, density and/or distribution into any one passage among the plurality of passages, a loss of fluid pressure may occur in the passage through which the gas and/or fluid of uneven concentration flows, and thereby, an overall loss of pressure may occur. However, a section available to distribute the gas concentration more evenly and/or uniformly may be secured for each of the passages, and a loss of gas pressure may be reduced or minimized.

The partition(s) 314 according to one or more exemplary embodiments of the present disclosure may form a plurality of passages in the duct, and widths of the respective passages may be uniform or very similar to each other at any cross section, as illustrated in FIG. 8. For example, widths w11, w12, and w13 of the passages at the inlets of the passages are identical with or very similar to each other. Widths w21, w22, and w23 of the passages at intermediate portions of the passages may also be identical with or very similar to each other. Likewise, widths w31, w32, and w33 of the passages at downstream parts of the passages may also be identical with or very similar to each other. Here, similarity means that when the width of one passage is defined as 100%, the width of another passage is 90% to 110% of the width of the one passage. When the widths of the respective passages are similar to each other, gas pressures in the respective passages may be similar to each other.

The duct body 310 according to exemplary embodiments of the present disclosure may have first and second stoppers (or tabs) 316 and 318 at the inlet. The heater 320 may be aligned using (e.g., between) the first stopper 316 and the second stopper 318. That is, vibrations may be generated when the washing machine is operated or driven, but the first and second stoppers 316 and 318 prevent the heater 320 from being arbitrarily shaken or moving, even though vibrations are transmitted thereto.

The duct body 310 according to exemplary embodiments of the present disclosure may have first terminal slits 317 in the duct side wall 312 at the inlet. A part of a terminal 328 of the heater 320 can be inserted into the first terminal slit 317. Therefore, when the heater 320 is installed on or attached to the duct body 310, the heater 320 is not misaligned or positionally distorted; rather, the heater 320 is disposed or positioned in a proper alignment.

The fan 330 according to exemplary embodiments of the present disclosure is installed at the inlet of the duct body 310 and outside the heater 320. The fan 330 blows the gas toward the heater 320. The fan 330 according to one or more exemplary embodiments of the present disclosure has a blower 332 in a fan housing 331, and the blower 332 is operated by a fan motor 334.

Opposite ends of the fan housing 331 may be open, and an opening 331*a* may be on or in a side surface of the fan housing 331.

The blower 332 is in the fan housing 331, and blows gas toward the opening 331*a*.

The fan motor 334 is installed on or attached to the fan housing 331, connected to a shaft 333 of the blower 332, and configured to rotate the blower 332 through the shaft 333 when the fan motor 334 is driven or operated.

The blower 332 may comprise a sirocco fan. Therefore, even though the blower 332 is driven at a relatively low rotational speed, a gas flow rate from the fan 330 may increase or be relatively high. Meanwhile, the fan motor 334 is driven so that a rotational speed of the blower 332 is low, thereby preventing excessive noise.

A cross-sectional shape of the opening 331*a* may correspond to a cross-sectional shape of the inlet formed by the duct body 310 and the duct cover 340. Therefore, gas flow from the blower 332 may be provided to the passage of the duct without a loss in the gas flow rate.

The duct cover 340 according to exemplary embodiments of the present disclosure is at an upper side of the duct body 310, and may be curved laterally (e.g., when viewed from the top) to correspond to the shape of the duct body 310.

The duct cover 340 according to one or more exemplary embodiments of the present disclosure may have grooves 344 at positions that correspond to the partitions 314. A part of each partition 314 is inserted into the groove 344. Therefore, the cross section of the passage of the duct is completely enclosed, thereby preventing gas from leaking in an arbitrary direction when the gas flows.

A curved portion 343 may be at one side or end of the duct cover 340 and positioned above or at an upper side of the tube 313. The grooves 344 are also formed in and/or extend to the curved portion 343. Therefore, even though a flow direction of the gas and/or fluid rapidly changes when the fluid flows along the passage(s) in the duct, resistance acting on the flow of the gas/fluid may be minimized by the curved portion 343. Therefore, the curved portion 343 may reduce or prevent a decrease in the flow velocity (e.g., of the gas).

Hereinafter, the heater 320 according to exemplary embodiments of the present disclosure will be described with reference to FIG. 9. The accompanying FIG. 9 is a view for explaining the heater for the dryer according to exemplary embodiments of the present disclosure.

As illustrated in FIGS. 4 to 6, the heater 320 according to exemplary embodiments of the present disclosure is installed at the inlet of the duct body 310, and heats the gas flowing into the inlet.

Figure 9:
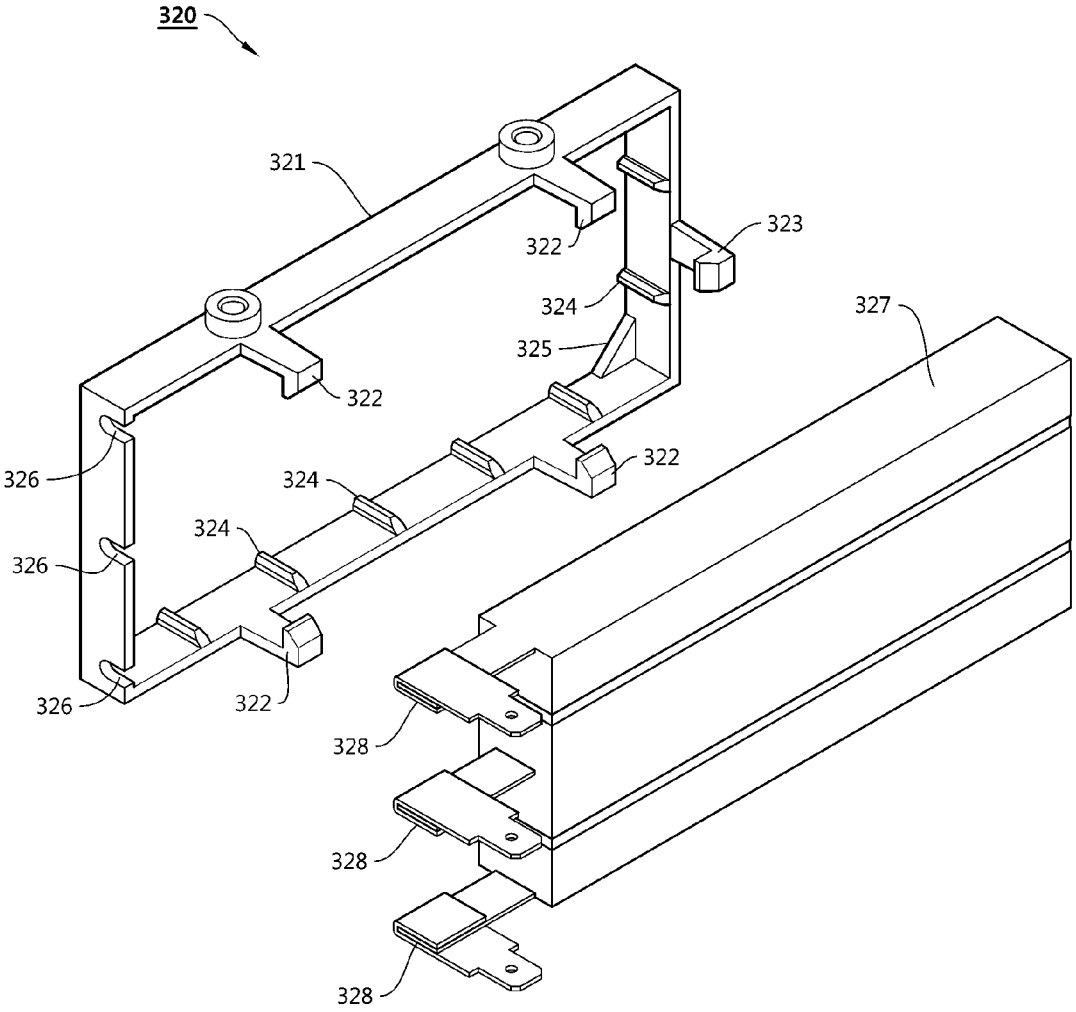
FIG. 9 is a view for explaining a heater according to exemplary embodiments of the present disclosure.

As illustrated in FIG. 9, the heater 320 has a configuration in which a heating device 327 is in and/or secured to a frame 321. The frame 321 has spacers 324 on an inner surface (e.g., along an entire inner circumference or on all inner surfaces) thereof. An interval or spacing is formed between the frame 321 and the heating device 327 by the spacers 324. The interval may prevent the frame 321 from being deformed by heat generated by the heating device 327.

First coupling structures (e.g., clips) 322 may be at upper and lower sides of the frame 321, and one or more second coupling structures 323 may be on one or more sides of the frame 321. That is, when the heating device 327 is mounted in or assembled with the frame 321, the heating device 327 may be first inserted at the side of the frame 321 opposite to the side having second coupling structure(s) 323 thereon, and sliding the heating device 323 into place under the first and second coupling structures 322 and 323.

one or more third stoppers (or tabs) 325 may be at one or more side and/or corners of the frame 321. The first and second coupling structures 322 and 323 may have a hook, L- or J-shape. Therefore, when the heating device 327 is mounted in the frame 321, the heating device 327 may be aligned between the first and second coupling structures 322 and 323 and the third stopper 325. The heating device 327 does not arbitrarily move when secured by the first and second coupling structures 322 and 323 and the third stopper 325.

Second terminal slits 326 are in the frame 321. The terminals 328 are on a side surface of the heating device 327. Therefore, when the heating device 327 is assembled in the frame 321, a part of the terminal 328 is inserted into the second terminal slit 326, and as a result, the heating device 327 is properly disposed or positioned in the frame 321 (e.g., within the internal space of the frame 321).

The dryer for a wall-mounted washing machine according the exemplary embodiments of the present disclosure configured as described above may have a compact size and/or external shape, provide a high gas flow rate, and produce warm air. That is, the dryer according to exemplary embodiments of the present disclosure may be mounted in a wall-mounted washing machine, thereby implementing a laundry-drying function for or in the wall-mounted washing machine.

The dryer for a wall-mounted washing machine according to exemplary embodiments of the present disclosure may be used to dry laundry.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A wall-mounted washing machine having a dryer, comprising:

a tub and/or drum;

a duct body having a passage therein configured to guide gas from an inlet to an outlet, wherein the passage is curved laterally and vertically, and the outlet is directed toward the tub and/or drum;

a heater at the inlet, configured to heat the gas;

a fan at the inlet, outside the heater, configured to blow the gas toward the heater;

a duct cover at an upper side of the duct body, and corresponding to a shape of the duct body; and a plurality of partitions on or in the passage, configured to maintain a flow velocity of the gas, wherein the duct cover comprises grooves at positions that correspond to the plurality of partitions, wherein the plurality of partitions are partially inside the grooves, wherein each of the plurality of partitions comprises an inclined portion disposed near the inlet, and wherein the inclined portions uniformly distribute at least one of gas and fluid to a plurality of passages formed by the plurality of partitions.

2. The dryer of claim 1, wherein the duct body comprises a tube at the outlet, and a cross-sectional area of the tube is smaller than a cross-sectional area of the passage at the inlet.

3. The dryer of claim 2, wherein the tube is configured to increase a flow velocity of the gas.

4. The dryer of claim 2, wherein the duct cover has a curved portion at a position corresponding to the tube.

5. The dryer of claim 2, wherein the plurality of partitions extend to the tube.

6. The dryer of claim 1, wherein each of the plurality of passages has a uniform width.

7. The dryer of claim 1, wherein the plurality of partitions is configured to prevent the gas from leaking.

8. The dryer of claim 1, further comprising first and second stoppers at the inlet, wherein the heater is aligned between the first stopper and the second stopper.

9. The dryer of claim 1, wherein the heater comprises:

a frame having a spacer on an inner surface thereof; and a heating device in the frame, wherein the spacer defines an interval between the frame and the heater that substantially prevents the frame from being deformed by heat from the heating device.

10. The dryer of claim 1, wherein the fan comprises:

a fan housing having open ends, and an opening in a side surface thereof;

a blower in the fan housing, configured to blow the gas toward the opening; and a fan motor in the fan housing configured to rotate the blower.

11. The dryer of claim 10, wherein the opening has a cross-sectional shape that corresponds to a cross-sectional shape of the inlet.

12. The dryer of claim 9, wherein the fan comprises a sirocco fan.

* * * * *